US008975542B2

(12) United States Patent
Owada et al.

(10) Patent No.: US 8,975,542 B2
(45) Date of Patent: Mar. 10, 2015

(54) PRESSING-TYPE INPUT DEVICE

(71) Applicant: Alps Electric Co., Ltd., Tokyo (JP)

(72) Inventors: Ko Owada, Miyagi-ken (JP); Tetsu Numata, Miyagi-ken (JP); Shigeto Gorai, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 286 days.

(21) Appl. No.: 13/752,218

(22) Filed: Jan. 28, 2013

(65) Prior Publication Data

US 2013/0206563 A1 Aug. 15, 2013

(30) Foreign Application Priority Data

Feb. 9, 2012 (JP) ..... 2012-026578

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/705*** | (2006.01) |
| ***H01H 25/04*** | (2006.01) |

(52) U.S. Cl.

CPC ..... *H01H 13/705* (2013.01); *H01H 25/041* (2013.01); *H01H 2215/004* (2013.01)

USPC ..... 200/5 A; 200/4; 200/6 A

(58) Field of Classification Search

USPC ..... 200/5 A, 4, 6 A, 6 R

See application file for complete search history.

(56) References Cited

U.S. PATENT DOCUMENTS

| | | | | |
|---|---|---|---|---|
| 8,502,093 | B2 * | 8/2013 | Kishimoto et al. | 200/5 A |
| 2002/0015021 | A1 | 2/2002 | Numata et al. | |
| 2012/0085629 | A1 * | 4/2012 | Vaziri et al. | 200/17 R |
| 2013/0248343 | A1 * | 9/2013 | Tanaka et al. | 200/6 A |

FOREIGN PATENT DOCUMENTS

| | | |
|---|---|---|
| JP | 2002-42612 | 2/2002 |

* cited by examiner

*Primary Examiner* — Renee S Luebke
*Assistant Examiner* — Lheiren Mae A Caroc
(74) *Attorney, Agent, or Firm* — Beyer Law Group LLP

(57) ABSTRACT

A switching substrate on which switching portions are mounted is attached at an angle to a case. The length in the pressing direction of a first push button of a push button unit is larger than the length in the pressing direction of a second push button. A first contact portion about which the push button unit rotates when the first push button is pressed and a second contact portion about which the push button unit rotates when the second push button is pressed are at substantially the same height from the surface of the switching substrate. Therefore, the rotation angle when a first operating surface is pressed can be made equal to the rotation angle when a second operating surface is pressed.

13 Claims, 10 Drawing Sheets

PRESSING-TYPE INPUT DEVICE

CLAIM OF PRIORITY

This application claims benefit of Japanese Patent Application No. 2012-026578 filed on Feb. 9, 2012, which is hereby incorporated by reference.

BACKGROUND OF THE INVENTION

1. Field of the Invention

The present invention relates to a pressing-type input device in which a push button unit having a plurality of push buttons that press switching members is movably supported, and more specifically, it relates to a pressing-type input device in which push buttons that differ in the distance from the operating surface to the pressing end portion are provided in the same push button unit.

2. Description of the Related Art

Japanese Unexamined Patent Application Publication No. 2002-42612 discloses an operating body supported by a panel. The operating body has four push buttons arranged in a cross shape and connected by a connecting body.

The connecting body is located at the center of the four push buttons, and the inner surface of the panel and the connecting body are in contact with each other. When any one of the push buttons is pressed, the operating body rotates about a pivot point that is a contact portion between the inner surface of the panel and the connecting body, and a switch member located under the pressed push button is switched.

Rotating the operating body about a pivot point that is a contact portion located at the center of the operating body prevents switch members other than the switch member located under the pressed push button from being switched.

In the operating device described in Japanese Unexamined Patent Application Publication No. 2002-42612, all of the four push buttons are the same size in the pressing direction. Therefore, all of the four push buttons are equal in stroke, and the four push buttons can be pressed with the same operational sensation.

However, in electronic devices in which the operating device is mounted, because of design considerations or the arrangement of other members, sometimes a supporting substrate supporting a plurality of switching members needs to be disposed at an angle with respect to the surface of the panel. When the supporting substrate is attached at an angle, the size in the pressing direction of any one of the push buttons needs to be made longer than that of the other push buttons according to the inclination angle of the supporting substrate.

However, when a mechanism that rotates an operating body having push buttons that differ in size in the pressing direction about a connecting body as described in Japanese Unexamined Patent Application Publication No. 2002-42612 is used, the stroke varies depending on the size of the push button, and the operational sensation varies depending on the push button being operated.

SUMMARY OF THE INVENTION

The present invention provides such a pressing-type input device that when a push button unit including push buttons that differ in size in the pressing direction and that are connected to each other is used, the difference in stroke and operational sensation between the push buttons can be made as small as possible.

In an aspect of the present invention, a pressing-type input device includes a case, a first push button and a second push button disposed on the surface of the case, a first switching portion pressed by the first push button, and a second switching portion pressed by the second push button, wherein a push button unit including at least the first push button and the second push button connected by a connecting portion is provided, the first push button has a first operating surface receiving pressing operating force and a first pressing end portion pressing the first switching portion, the second push button has a second operating surface receiving pressing operating force and a second pressing end portion pressing the second switching portion, and the distance from the first operating surface to the first pressing end portion is longer than the distance from the second operating surface to the second pressing end portion, wherein between the push button unit and the case or a fixed portion other than the case, a first contact portion serving as a pivot point for the push button unit when the first operating surface is pressed is provided on the second push button side of a center line passing between the first push button and the second push button, and a second contact portion serving as a pivot point for the push button unit when the second operating surface is pressed is provided on the first push button side of the center line, and wherein the distance from the first operating surface to the second contact portion is longer than the distance from the second operating surface to the second contact portion.

A switching substrate supporting the first switching portion and the second switching portion may be provided inside the case, the switching substrate may be attached at an angle with respect to the surface of the case, and the distance from the surface of the case to the first switching portion may be longer than the distance from the surface of the case to the second switching portion.

In the pressing-type input device of the present invention, although the first push button is longer than the second push button in the pressing direction, the difference between the distance from the first contact portion to the first pressing end portion and the distance from the second contact portion to the second pressing end portion can be reduced. In addition, the difference between the distance from the first contact portion to the switching substrate and the distance from the second contact portion to the switching substrate can also be reduced. As a result, the difference between the stroke in the pressing direction when the first push button is pressed to operate the first switching portion and the stroke in the pressing direction when the second push button is pressed to operate the second switching portion can be reduced, and the difference between the operational sensation when the first push button is pressed and the operational sensation when the second push button is pressed can be reduced.

The distance from the first contact portion to the switching substrate is preferably shorter than the distance from the first contact portion to the second operating surface, and the distance from the second contact portion to the switching substrate is preferably shorter than the distance from the second contact portion to the first operating surface. The first contact portion is preferably closer to the switching substrate than the second pressing end portion, and the second contact portion is preferably closer to the switching substrate than the first pressing end portion.

In the above configuration, the first switching portion can be pressed with the first pressing end portion without extreme inclination when the first push button is pressed, and the second switching portion can be pressed with the second pressing end portion without extreme inclination when the second push button is pressed. As a result, the switching of the first switching portion and the second switching portion can be reliably performed.

The push button unit may include a third push button and a fourth push button arranged in a direction intersecting with the direction in which the first push button and the second push button are arranged, a third switching member pressed by a third pressing end portion of the third push button and a fourth switching member pressed by a fourth pressing end portion of the fourth push button may be provided, and the first contact portion and the second contact portion may be provided between the third push button and the case or the fixed portion and between the fourth push button and the case or the fixed portion.

A third contact portion serving as a pivot point for the push button unit when the third push button is pressed and a fourth contact portion serving as a pivot point for the push button unit when the fourth push button is pressed may be provided between the first push button and the case or the fixed portion and between the second push button and the case or the fixed portion.

Since, in the above configuration, the first contact portion and the second contact portion are provided in the third push button and the fourth push button and the third contact portion and the fourth contact portion are provided in the first push button and the second push button, the first to fourth contact portions can be set just by placing the push button unit into the case, and the mechanism can be simply configured.

In another aspect of the present invention, a pressing-type input device includes a case, a first push button, a second push button, a third push button, and a fourth push button disposed on the surface of the case, a first switching portion pressed by the first push button, a second switching portion pressed by the second push button, a third switching portion pressed by the third push button, and a fourth switching portion pressed by the fourth push button, wherein a push button unit including the first push button, the second push button, the third push button, and the fourth push button connected by a connecting portion is provided, and the direction in which the first push button and the second push button are arranged intersects the direction in which the third push button and the fourth push button are arranged, wherein the first push button has a first operating surface receiving pressing operating force and a first pressing end portion pressing the first switching portion, the second push button has a second operating surface receiving pressing operating force and a second pressing end portion pressing the second switching portion, and the distance from the first operating surface to the first pressing end portion is longer than the distance from the second operating surface to the second pressing end portion, wherein between the third push button and the case or a fixed portion other than the case and between the fourth push button and the case or the fixed portion, a first contact portion serving as a pivot point for the push button unit when the first operating surface is pressed is provided on the second push button side of a center line passing between the first push button and the second push button, and a second contact portion serving as a pivot point for the push button unit when the second operating surface is pressed is provided on the first push button side of the center line, and wherein the distance from the first operating surface to the second contact portion is longer than the distance from the second operating surface to the second contact portion.

In the above pressing-type input device, a third contact portion serving as a pivot point for the push button unit when the third push button is pressed and a fourth contact portion serving as a pivot point for the push button unit when the fourth push button is pressed may be provided between the first push button and the case or the fixed portion and between the second push button and the case or the fixed portion.

Since, in the present invention, a substrate on which switching portions are mounted can be attached at an angle with respect to an operating surface on the surface of a case, the degree of freedom of design of a pressing-type input device can be improved.

DESCRIPTION OF THE PREFERRED EMBODIMENTS

Figure 1:
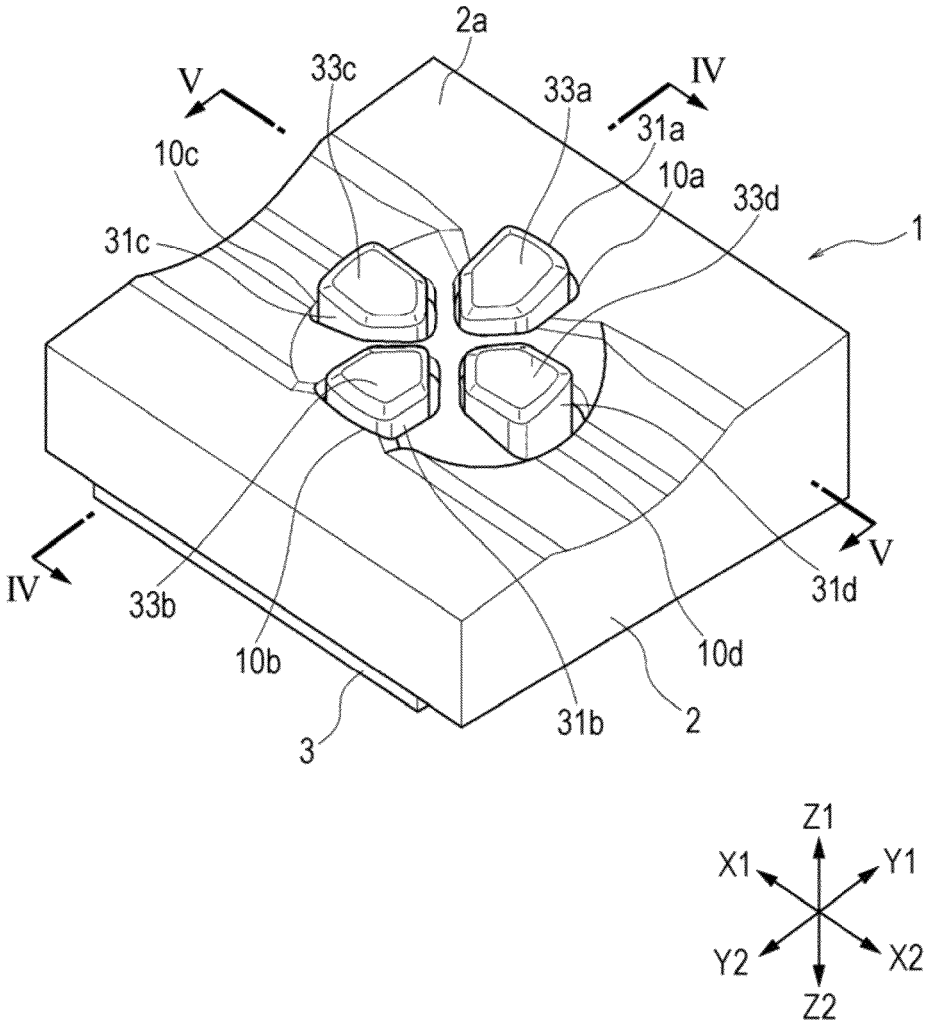
FIG. 1 is a perspective view showing the appearance of a pressing-type input device of an embodiment of the present invention.
Figure 2:
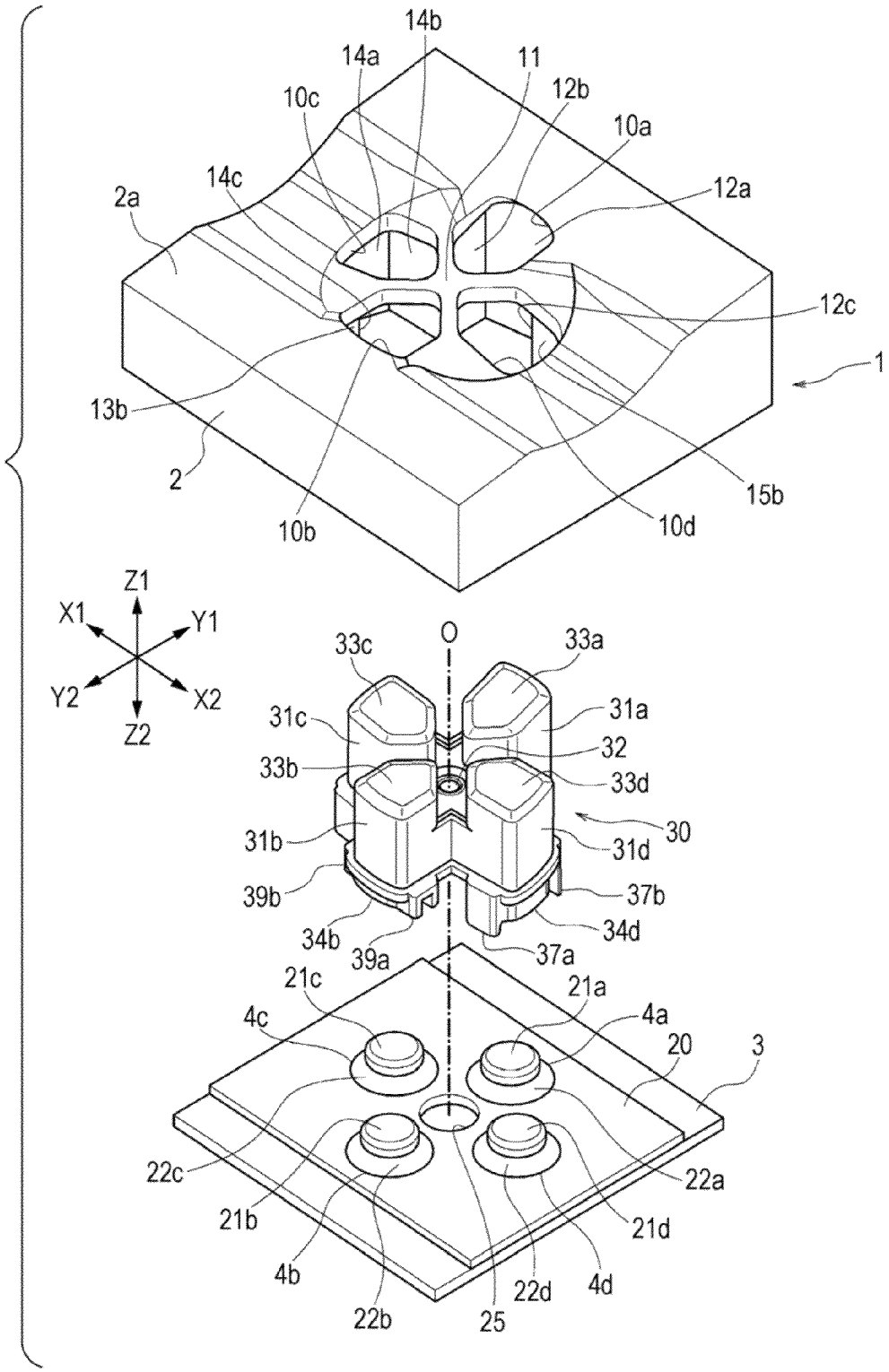
FIG. 2 is an exploded perspective view of the pressing-type input device shown in FIG. 1.

A pressing-type input device 1 shown in FIG. 1 and FIG. 2 has a case 2 whose surface is an operating surface 2*a* and a switching substrate 3 placed inside the case 2 or at the back of the case 2. A switching sheet 20 is placed on the switching substrate 3, and a push button unit 30 is provided between the inner surface of the case 2 and the switching sheet 20.

The case 2 and the switching substrate 3 of the embodiment shown in FIG. 1 and FIG. 2 are small, and only one push button unit 30 is provided as an operating member. However, a pressing-type input device 1 of the present invention may have a larger case 2 and a larger switching substrate 3, and in addition to a push button unit 30, one or more sets of operating members.

As shown in FIG. 1 and FIG. 2, the case 2 has a first hole 10*a*, a second hole 10*b*, a third hole 10*c*, and a fourth hole 10*d* that open on the operating surface 2*a*. The first hole 10*a* and the second hole 10*b* are arranged in the vertical direction (Y direction), and the third hole 10*c* and the fourth hole 10*d* are arranged in the horizontal direction (X direction). The holes 10*a*, 10*b*, 10*c*, and 10*d* are separated by a separating portion 11 that forms a part of the operating surface 2*a* of the case 2.

Figure 3:
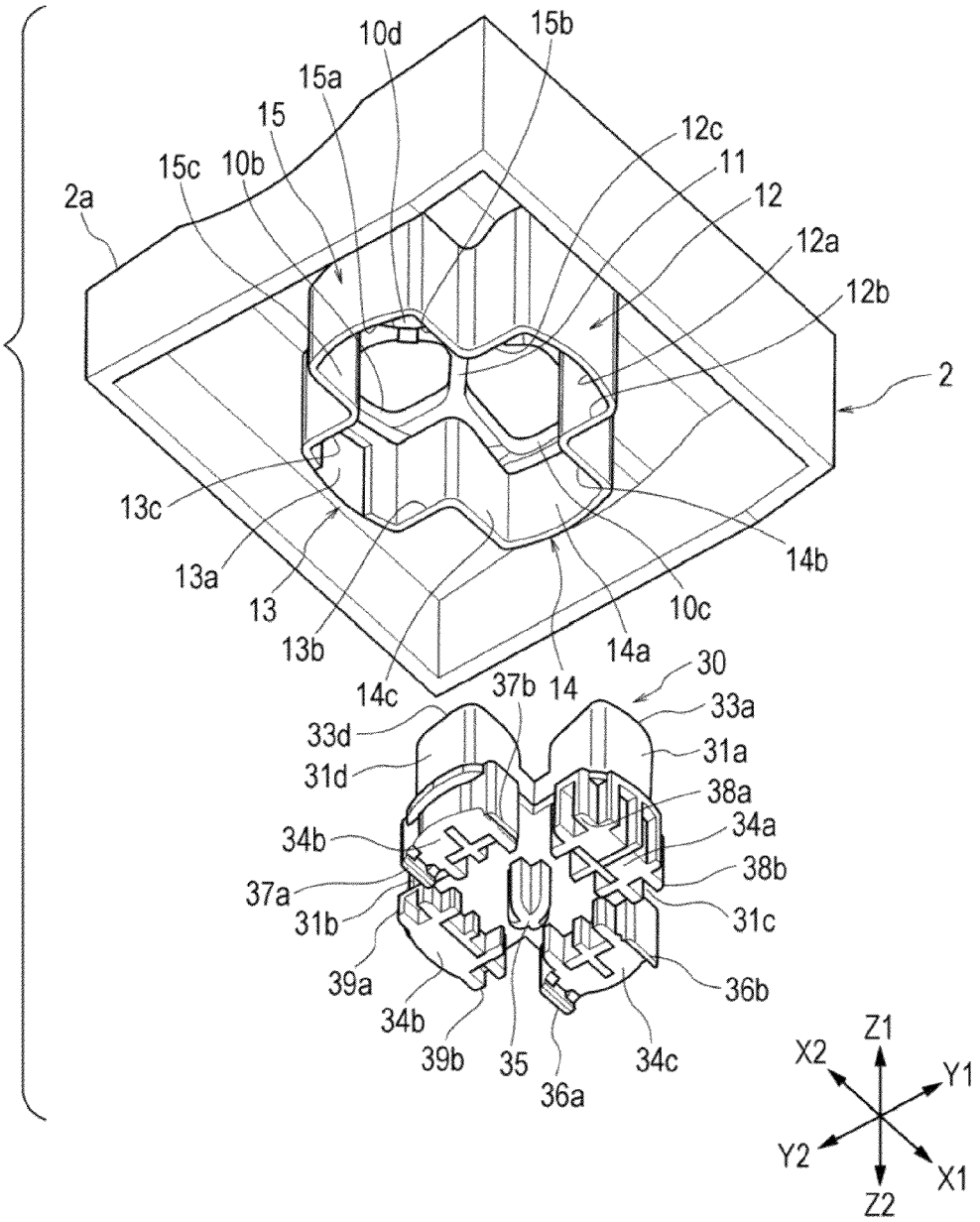
FIG. 3 is an exploded perspective view of a case and a push button unit of the pressing-type input device viewed from the inside of the case.

As shown in FIG. 3, inside the case 2, there are provided a first guide portion 12 extending integrally inward from the edge of the first hole 10*a*, a second guide portion 13 extending integrally inward from the edge of the second hole 10*b*, a third guide portion 14 extending integrally inward from the edge of the third hole 10*c*, and a fourth guide portion 15 extending integrally inward from the edge of the fourth hole 10*d*.

As shown in FIG. 3, the first guide portion 12 includes an outer wall portion 12*a* on the Y1 side, a side wall portion 12*b* on the X1 side, and a side wall portion 12*c* on the X2 side. The second guide portion 13 includes an outer wall portion 13*a* on the Y2 side, a side wall portion 13*b* on the X1 side, and a side wall portion 13*c* on the X2 side. The third guide portion 14 includes an outer wall portion 14*a* on the X1 side, a side wall portion 14*b* on the Y1 side, and a side wall portion 14*c* on the Y2 side. The fourth guide portion 15 includes an outer wall portion 15*a* on the X2 side, a side wall portion 15*b* on the Y1 side, and a side wall portion 15*c* on the Y2 side.

As shown in FIG. 1 to FIG. 3, the push button unit 30 is made of a synthetic resin, and includes a first push button 31*a*, a second push button 31*b*, a third push button 31*c*, and a fourth push button 31*d* that are integrally formed. The first push button 31*a* and the second push button 31*b* face each other with a space therebetween in the vertical direction (Y direction), and the third push button 31*c* and the fourth push button 31*d* face each other with a space therebetween in the horizontal direction (X direction).

The push buttons 31*a*, 31*b*, 31*c*, and 31*d* are connected by a connecting portion 32. As shown in FIG. 1 and FIG. 2, the upper surface of the first push button 31*a* is a first operating surface 33*a*, the upper surface of the second push button 31*b* is a second operating surface 33*b*, the upper surface of the third push button 31*c* is a third operating surface 33*c*, and the upper surface of the fourth push button 31*d* is a fourth operating surface 33*d*. As shown in FIG. 3, in the push button unit 30, a first pressing end portion 34*a* is provided in the lower part of the first push button 31*a*. Similarly, a second pressing end portion 34*b* is provided in the lower part of the second push button 31*b*, a third pressing end portion 34*c* is provided in the lower part of the third push button 31*c*, and a fourth pressing end portion 34*d* is provided in the lower part of the fourth push button 31*d*. As shown in FIG. 3, a supporting protrusion 35 protruding downward (in the Z2 direction) is integrally formed at the center of the four pressing end portions 34*a*, 34*b*, 34*c*, and 34*d*.

The upper parts of the push buttons 31*a*, 31*b*, 31*c*, and 31*d* are protruding upward (in the Z1 direction) above the connecting portion 32. On the upper surfaces of these upper parts, the operating surfaces 33*a*, 33*b*, 33*c*, and 33*d* are formed.

The push button unit 30 is attached so as to face upward (in the Z1 direction) from the inside of the case 2. The first push button 31*a* is inserted into the inside of the first guide portion 12, and the second push button 31*b*, the third push button 31*c*, and the fourth push button 31*d* are inserted into the insides of the second guide portion 13, the third guide portion 14, and the fourth guide portion 15, respectively. When the push button unit 30 is inserted until the connecting portion 32 comes into contact with the inner surface of the separating portion 11 of the case 2, as shown in FIG. 1, the upper part of the first push button 31*a* protrudes upward (in the Z1 direction) from the first hole 10*a* of the case 2, and the upper part of the second push button 31*b*, the upper part of the third push button 31*c*, and the upper part of the fourth push button 31*d* protrude upward from the second hole 10*b*, the third hole 10*c*, and the fourth hole 10*d*, respectively.

Figure 4:
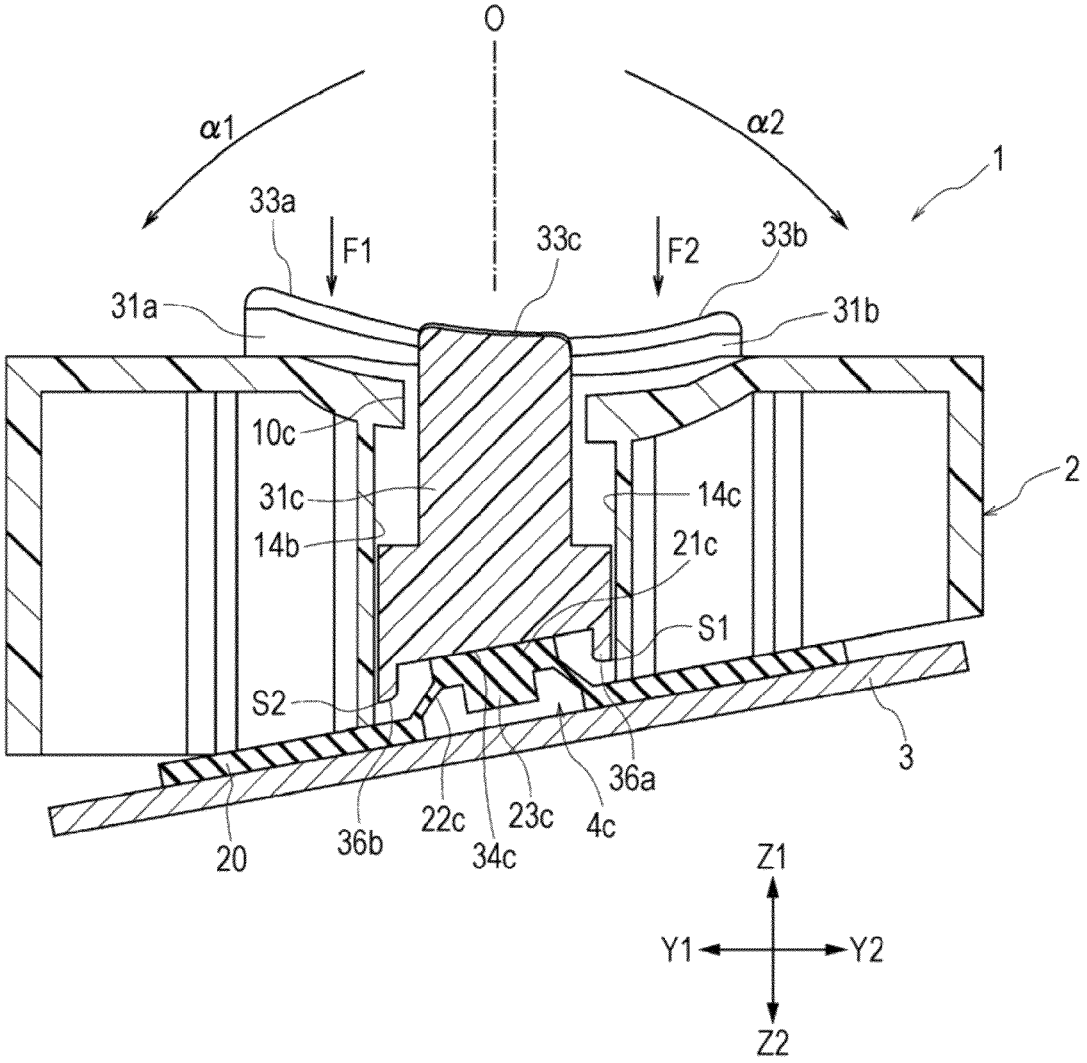
FIG. 4 is a sectional view taken along line IV-IV of FIG. 1.
Figure 5:
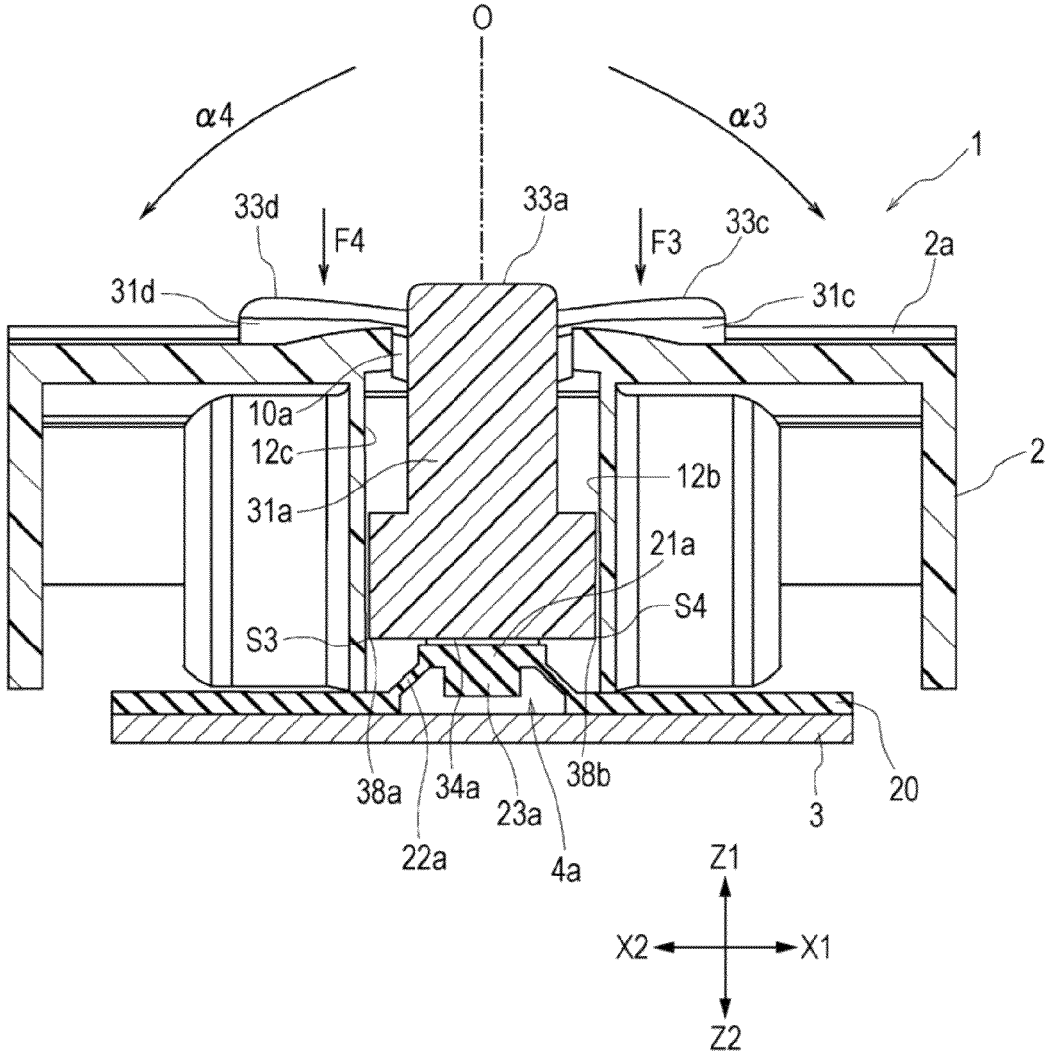
FIG. 5 is a sectional view taken along line V-V of FIG. 1.

In FIG. 2, a center line O passing through the center of the connecting portion 32 of the push button unit 30 is shown. As shown in FIG. 4 and FIG. 5, the center line O is parallel to the axial direction of each of the push buttons 31*a*, 31*b*, 31*c*, and 31*d*. When the push button unit 30 is attached to the case 2 without inclining, the center line O is parallel to the surfaces of the outer wall portions 12*a*, 13*a*, 14*a*, and 15*a* and the side wall portions 12*b*, 12*c*, 13*b*, 13*c*, 14*b*, 14*c*, 15*b*, and 15*c* of the guide portions 12, 13, 14, and 15.

As shown in FIG. 4 and FIG. 5, after the push button unit 30 is attached to the case 2, the switching substrate 3 is placed on the underside (on the Z2 side) of the case 2, and the switching substrate 3 is fixed to the case 2 with screws or the like.

As shown in FIG. 2, a first switching portion 4*a*, a second switching portion 4*b*, a third switching portion 4*c*, and a fourth switching portion 4*d* are provided on the top of the switching substrate 3. The first switching portion 4*a* and the second switching portion 4*b* are arranged in the vertical direction (Y direction), and the third switching portion 4*c* and the fourth switching portion 4*d* are arranged in the horizontal direction (X direction) perpendicular to the vertical direction.

The first to fourth switching portions 4*a*, 4*b*, 4*c*, and 4*d* are all pressing-type switch portions. The switching sheet 20 is formed of an elastic material such as synthetic rubber. As shown in FIG. 2, the first switching portion 4*a* has a pressing portion 21*a* formed by a part of the switching sheet 20, and a tapered elastic supporting portion 22*a* that moves the pressing portion 21*a* up and down. Similarly, the second switching portion 4*b*, the third switching portion 4*c*, and the fourth switching portion 4*d* have pressing portions 21*b*, 21*c*, and 21*d*, and elastic supporting portions 22*b*, 22*c*, and 22*d* integral therewith.

As shown in FIG. 5, the first switching portion 4*a* has a switching protrusion 23*a* provided under the pressing portion 21*a* integrally therewith. A pair of electrodes are provided on the surface of the switching substrate 3, and a conductive portion is provided on the underside of the switching protrusion 23*a*. When the first switching portion 4*a* is pressed, and the conductive portion of the switching protrusion 23*a* comes into contact with the pair of electrodes, the first switching portion 4*a* operates as a switch portion.

Alternatively, a pair of electrodes and a resistive layer formed between the pair of electrodes are provided on the surface of the switching substrate 3, an elastically deformable switching protrusion 23*a* is formed of a conductive resin, and the conductive resin has a specific resistance lower than that of the resistive layer. In this first switching portion 4*a*, if, after the pressing portion 21*a* is pressed and the conductive resin comes into contact with the resistive layer, the pressing force imparted to the pressing portion 21*a* changes, the contact area between the low-resistance conductive resin and the resistive layer changes in accordance with the pressing force, and the resistance between the electrodes changes. Therefore, the detection whether or not the pressing portion 21*a* is pressed, and the switching output according to the change of the pressing force imparted to the pressing portion 21*a* can be obtained.

Similarly, the second switching portion 4*b*, the third switching portion 4*c*, and the fourth switching portion 4*d* are provided with switching protrusions 23*b*, 23*c*, and 23*d* and electrodes and others. In FIG. 4, the switching protrusion 23*c* of the third switching portion 4*c* is shown.

Figure 6A:
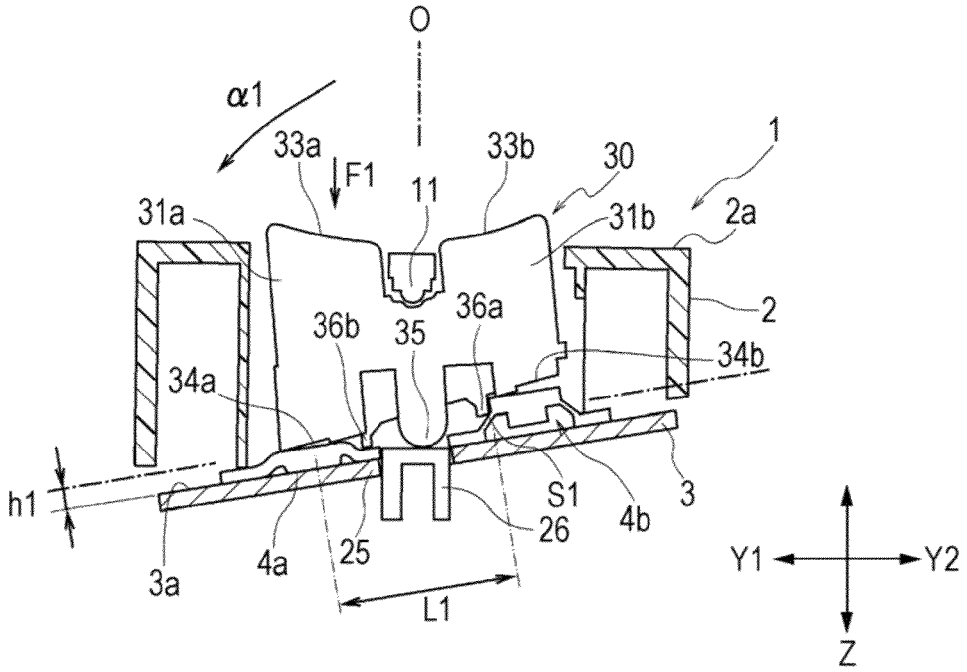
FIGS. 6A and 6B are explanatory views showing the inclination of the push button unit in the same section as that shown in FIG. 4.
Figure 6B:
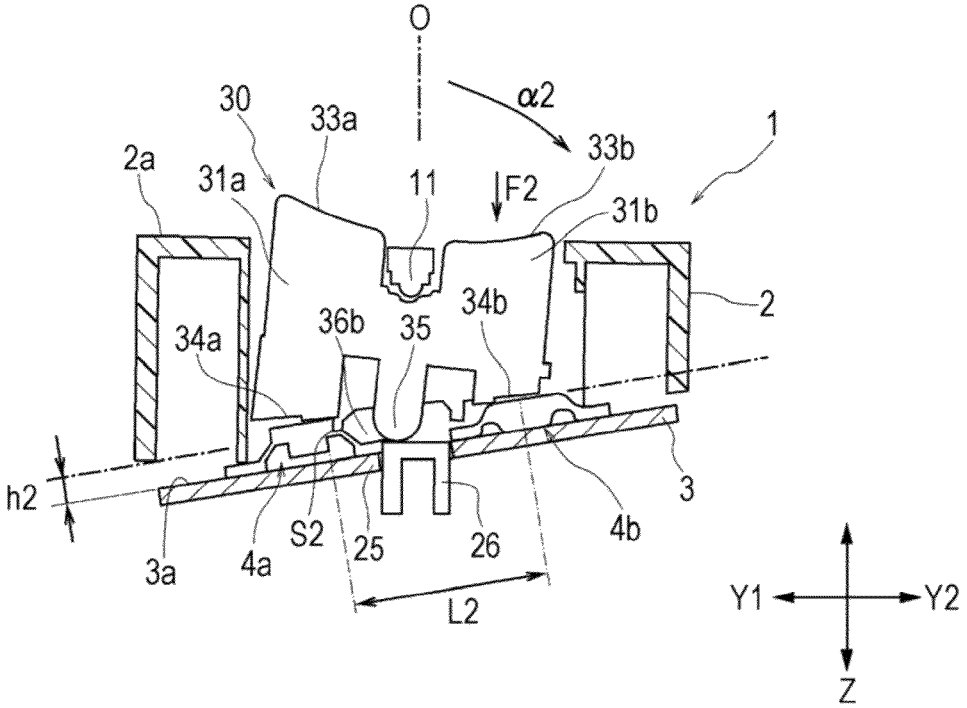

As shown in FIG. 2, a hole 25 is formed at the center of the four switching portions 4*a*, 4*b*, 4*c*, and 4*d*, through the switching substrate 3 and the switching sheet 20. As shown in FIGS. 6A and 6B, a supporting body 26 is placed inside the hole 25.

As shown in FIG. 4, the switching substrate 3 is attached so as to be inclined with respect to the operating surface 2*a*, the front surface of the case 2, downwardly in the Y1 direction. On the other hand, as shown in FIG. 5, the switching substrate 3 is attached without inclining in the X1-X2 direction. That is to say, the switching substrate 3 is attached to the case 2 such that a perpendicular extending from the surface of the switching substrate 3 is leaning with respect to the center line O only in the Y1 direction and is not leaning in the X1-X2 direction.

When the switching substrate 3 is attached at an angle, the distance from the first hole 10*a* opening on the operating surface 2*a* of the case 2 to the first switching portion 4*a* is longer than the distance from the second hole 10*b* to the second switching portion 4*b*. However, the distance from the third hole 10*c* to the third switching portion 4*c* is equal to the distance from the fourth hole 10*d* to the fourth switching portion 4*d*.

As shown in FIGS. 6A and 6B, in the push button unit 30, the distance from the first operating surface 33*a* of the first push button 31*a* to the first pressing end portion 34*a* is longer than the distance from the second operating surface 33*b* of the second push button 31*b* to the second pressing end portion 34*b*, the first pressing end portion 34*a* is located at a position where it can press the first switching portion 4*a*, and the second pressing end portion 34*b* is located at a position where it can press the second switching portion 4*b*.

Figure 7A:
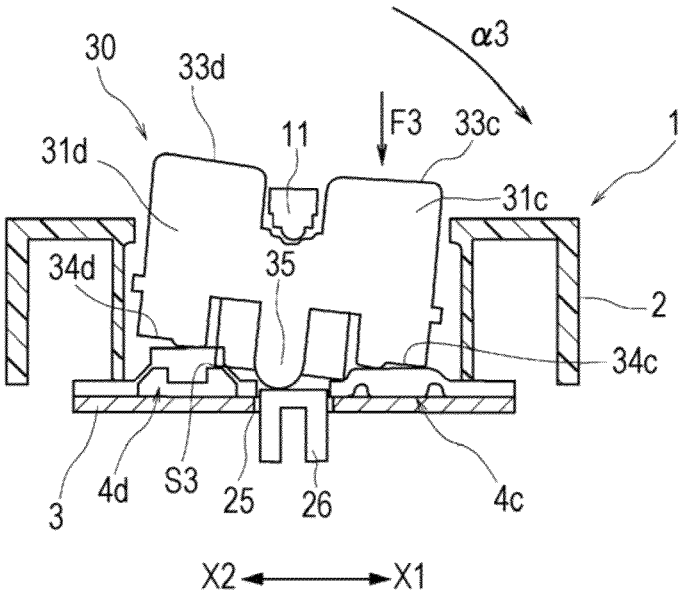
FIGS. 7A and 7B are explanatory views showing the inclination of the push button unit in the same section as that shown in FIG. 5.
Figure 7B:
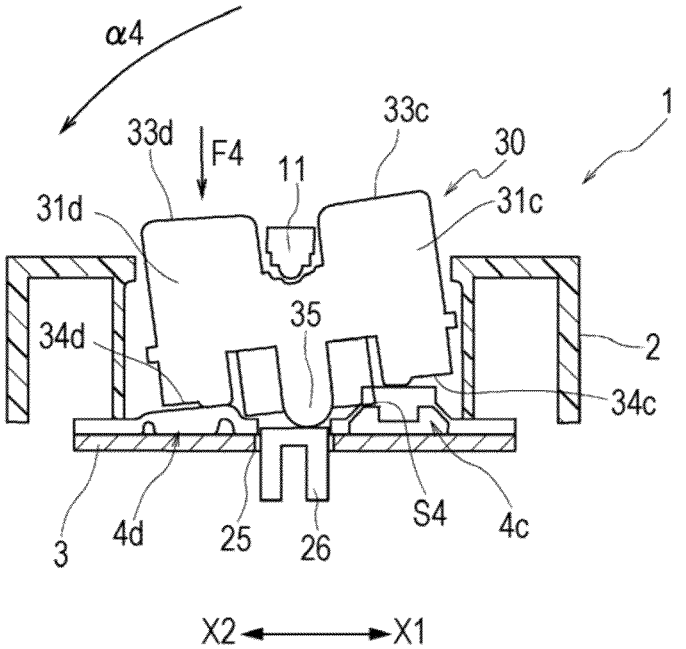

As shown in FIGS. 7A and 7B, the distance from the third operating surface 33*c* of the third push button 31*c* to the third pressing end portion 34*c* is substantially equal to the distance from the fourth operating surface 33*d* of the fourth push button 31*d* to the fourth pressing end portion 34*d*, the third pressing end portion 34*c* is located at a position where it can press the third switching portion 4*c*, and the fourth pressing end portion 34*d* is located at a position where it can press the fourth switching portion 4*d*.

As shown in FIGS. 6A and 6B and FIGS. 7A and 7B, the push button unit 30 is housed between the case 2 and the switching substrate 3, the connecting portion 32 faces the inner surface of the separating portion 11 of the case 2, the downwardly protruding supporting protrusion 35 faces the supporting body 26 placed in the hole 25 of the switching substrate 3, and the push button unit 30 is supported so as to be able to lean in the Y1 direction, the Y2 direction, the X1 direction, and the X2 direction.

As shown in FIG. 3, at the lower end of the third push button 31*c*, a first contact protrusion 36*a* is integrally formed on the Y2 side, and a second contact protrusion 36*b* is integrally formed on the Y1 side. At the lower end of the fourth push button 31*d*, a first contact protrusion 37*a* is integrally formed on the Y2 side, and a second contact protrusion 37*b* is integrally formed on the Y1 side.

As shown in FIG. 4, when the push button unit 30 is attached to the case 2, the lower end of the first contact protrusion 36*a* of the third push button 31*c* faces the side wall portion 14*c* on the Y2 side of the third guide portion 14 of the case 2, and the lower end of the second contact protrusion 36*b* of the third push button 31*c* faces the side wall portion 14*b* on the Y1 side of the third guide portion 14. Similarly, the lower end of the first contact protrusion 37*a* of the fourth push button 31*d* faces the side wall portion 15*c* on the Y2 side of the fourth guide portion 15, and the lower end of the second contact protrusion 37*b* of the fourth push button 31*d* faces the side wall portion 15*b* on the Y1 side of the fourth guide portion 15.

As shown in FIG. 4 and FIG. 6A, when the first operating surface 33*a* of the first push button 31*a* is pressed by a pressing force Fl toward the Z2 direction, the push button unit 30 rotates in the α1 direction about a first pivot point that is a first contact portion 51 including two contact points: the contact point between the lower end of the first contact protrusion 36*a* and the side wall portion 14*c*, and the contact point between the lower end of the first contact protrusion 37*a* and the side wall portion 15*c*, and the first switching portion 4*a* is pressed by the first pressing end portion 34*a* of the first push button 31*a*.

As shown in FIG. 4 and FIG. 6B, when the second operating surface 33*b* of the second push button 31*b* is pressed by a pressing force F2 toward the Z2 direction, the push button unit 30 rotates in the α2 direction about a second pivot point that is a second contact portion S2 including two contact points: the contact point between the lower end of the second contact protrusion 36*b* and the side wall portion 14*b*, and the contact point between the lower end of the second contact protrusion 37*b* and the side wall portion 15*b*, and the second switching portion 4*b* is pressed by the second pressing end portion 34*b* of the second push button 31*b*.

As shown in FIG. 3, at the lower end of the first push button 31*a*, a third contact protrusion 38*a* is integrally formed on the X2 side, and a fourth contact protrusion 38*b* is integrally formed on the X1 side. At the lower end of the second push button 31*b*, a third contact protrusion 39*a* is integrally formed on the X2 side, and a fourth contact protrusion 39*b* is integrally formed on the X1 side.

As shown in FIG. 5, when the push button unit 30 is attached to the case 2, the lower end of the third contact protrusion 38*a* of the first push button 31*a* faces the side wall portion 12*c* on the X2 side of the first guide portion 12 of the case 2, and the lower end of the fourth contact protrusion 38*b* of the first push button 31*a* faces the side wall portion 12*b* on the X1 side of the first guide portion 12. Similarly, the lower end of the third contact protrusion 39*a* of the second push button 31*b* faces the side wall portion 13*c* on the X2 side of the second guide portion 13, and the lower end of the fourth contact protrusion 39*b* of the second push button 31*b* faces the side wall portion 13*b* on the X1 side of the second guide portion 13.

As shown in FIG. 5 and FIG. 7A, when the third operating surface 33*c* of the third push button 31*c* is pressed by a pressing force F3 toward the Z2 direction, the push button unit 30 rotates in the α3 direction about a third pivot point that is a third contact portion S3 including two contact points: the contact point between the lower end of the third contact protrusion 38*a* and the side wall portion 12*c*, and the contact point between the lower end of the third contact protrusion 39*a* and the side wall portion 13*c*, and the third switching portion 4*c* is pressed by the third pressing end portion 34*c* of the third push button 31*c*.

As shown in FIG. 5 and FIG. 7B, when the fourth operating surface 33*d* of the fourth push button 31*d* is pressed by a pressing force F4 toward the Z2 direction, the push button unit 30 rotates in the a4 direction about a fourth pivot point that is a fourth contact portion S4 including two contact points: the contact point between the lower end of the fourth contact protrusion 38*b* and the side wall portion 12*b*, and the contact point between the lower end of the fourth contact protrusion 39*b* and the side wall portion 13*b*, and the fourth switching portion 4*d* is pressed by the fourth pressing end portion 34*d* of the fourth push button 31*d*.

Next, the operation when, in the pressing-type input device 1 of the embodiment of the present invention, the first push button 31*a* and the second push button 31*b* are operated will be described in contrast with a comparative example.

Figure 8A:
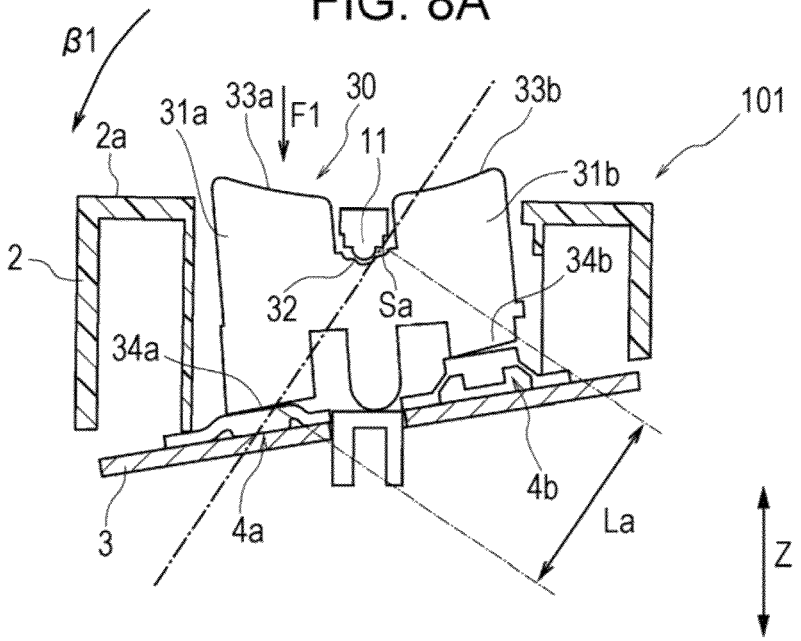
FIGS. 8A and 8B are explanatory views showing the inclination of a push button unit in a pressing-type input device of a comparative example.
Figure 8B:
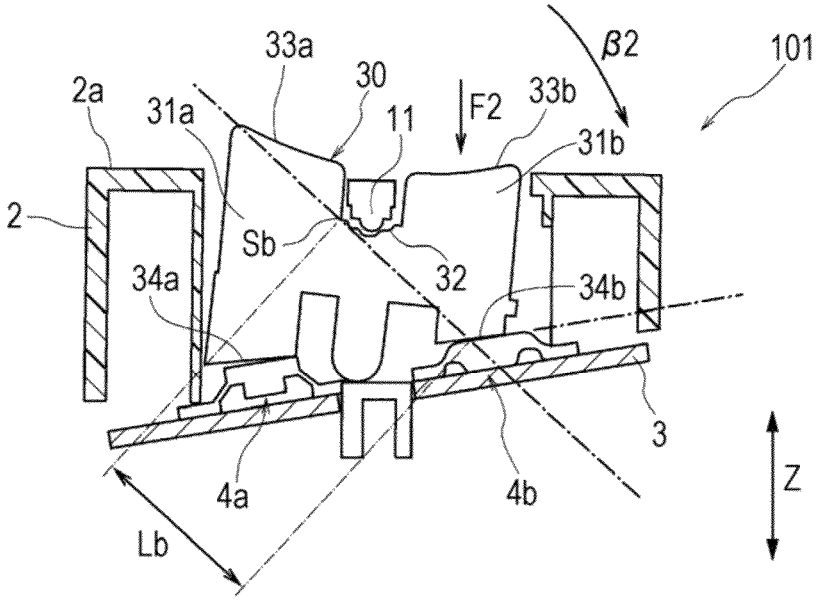

A pressing-type input device 101 of a comparative example shown in FIGS. 8A and 8B rotates about a pivot point that is a contact portion between a connecting portion 32 of a push button unit 30 and the inner surface of a separating portion 11 of a case 2.

As shown in FIG. 8A, in the comparative example, when a first operating surface 33*a* of a first push button 31*a* is pressed by a pressing force F1, the push button unit 30 rotates in the (31 direction about a pivot point that is a first contact portion Sa between the connecting portion 32 and the separating portion 11, and a first switching portion 4*a* is pressed by a first pressing end portion 34*a*. As shown in FIG. 8B, when a second operating surface 33*b* of a second push button 3*b* is pressed by a pressing force F2, the push button unit 30 rotates in the 132 direction about a pivot point that is a second contact portion Sb between the connecting portion 32 and the separating portion 11, and a second switching portion 4*b* is pressed by a second pressing end portion 34*b*.

In the pressing-type input device 101 of the comparative example shown in FIGS. 8A and 8B, the height distance in the Z direction from the first contact portion Sa to the second operating surface 33*b* is substantially equal to the height distance from the second contact portion Sb to the first operating surface 33*a*. On the other hand, the height distance from the first operating surface 33*a* of the first push button 31*a* to the first pressing end portion 34*a* is longer than the height distance from the second operating surface 33*b* of the second push button 3*b* to the second pressing end portion 34*b*. Therefore, the distance La from the first contact portion Sa to the center of the first pressing end portion 34*a* is longer than the distance Lb from the second contact portion Sb to the center of the second pressing end portion 34*b*.

In the first switching portion 4*a* and the second switching portion 4*b*, input signals are switched by pressing a pressing portion 21*a* and a pressing portion 21*b* against a switching substrate 3. Since La>Lb, in order to make the amount of pressing deformation of the first switching portion 4*a* equal to the amount of pressing deformation of the second switching portion 4*b*, the operation angle in the β2 direction when the second operating surface 33*b* is pressed needs to be made larger than the operation angle in the β1 direction when the first operating surface 33*a* is pressed.

Therefore, the operational sensation when the first operating surface 33*a* is pressed to operate the first switching portion 4*a* differs from the operational sensation when the second operating surface 33*b* is pressed to operate the second switching portion 4*b*.

As shown in FIGS. 6A and 6B, in the pressing-type input device 1 of the embodiment of the present invention, the first contact portion 51 about which the push button unit 30 rotates when the first operating surface 33*a* is pressed exists on the second push button 3*b* side of the center line O, and the second contact portion S2 about which the push button unit 30 rotates when the second operating surface 33*b* is pressed exists on the first push button 31*a* side of the center line O.

The height distance in the Z direction from the first operating surface 33*a* to the second contact portion S2 is longer than the height distance from the second operating surface 33*b* to the first contact portion S1. That is to say, the difference between the distance h1 from the surface 3*a* of the switching substrate 3 to the first contact portion S1 shown in FIG. 6A and the distance h2 from the surface 3*a* of the switching substrate 3 to the second contact portion S2 shown in FIG. 6B is small, and preferably, the distance h1 is substantially equal to the distance h2.

Therefore, the difference between the distance L1 from the first contact portion S1 to the center of the first pressing end portion 34*a* and the distance L2 from the second contact portion S2 to the center of the second pressing end portion 34*b* is small. That is to say, the absolute value of L1−L2 in the embodiment shown in FIGS. 6A and 6B is smaller than the absolute value of La−Lb in the comparative example shown in FIGS. 8A and 8B.

Therefore, in the embodiment, when the rotation angle in the α1 direction of the push button unit 30 when the first operating surface 33*a* is pressed is made substantially equal to the rotation angle in the α2 direction of the push button unit 30 when the second operating surface 33*b* is pressed, the amount of pressing deformation of the first switching portion 4*a* can be made equal to the amount of deformation of the second switching portion 4*b*. Therefore, when the switching substrate 3 is inclined with respect to the operating surface 2*a* that is the surface of the case 2, or when the length in the pressing direction of the first push button 31*a* differs from that of the second push button 31*b*, the operational sensation when the first operating surface 33*a* is pressed to operate the first switching portion 4*a* can be made equal to the operational sensation when the second operating surface 33*b* is pressed to operate the second switching portion 4*b*.

Figure 9:
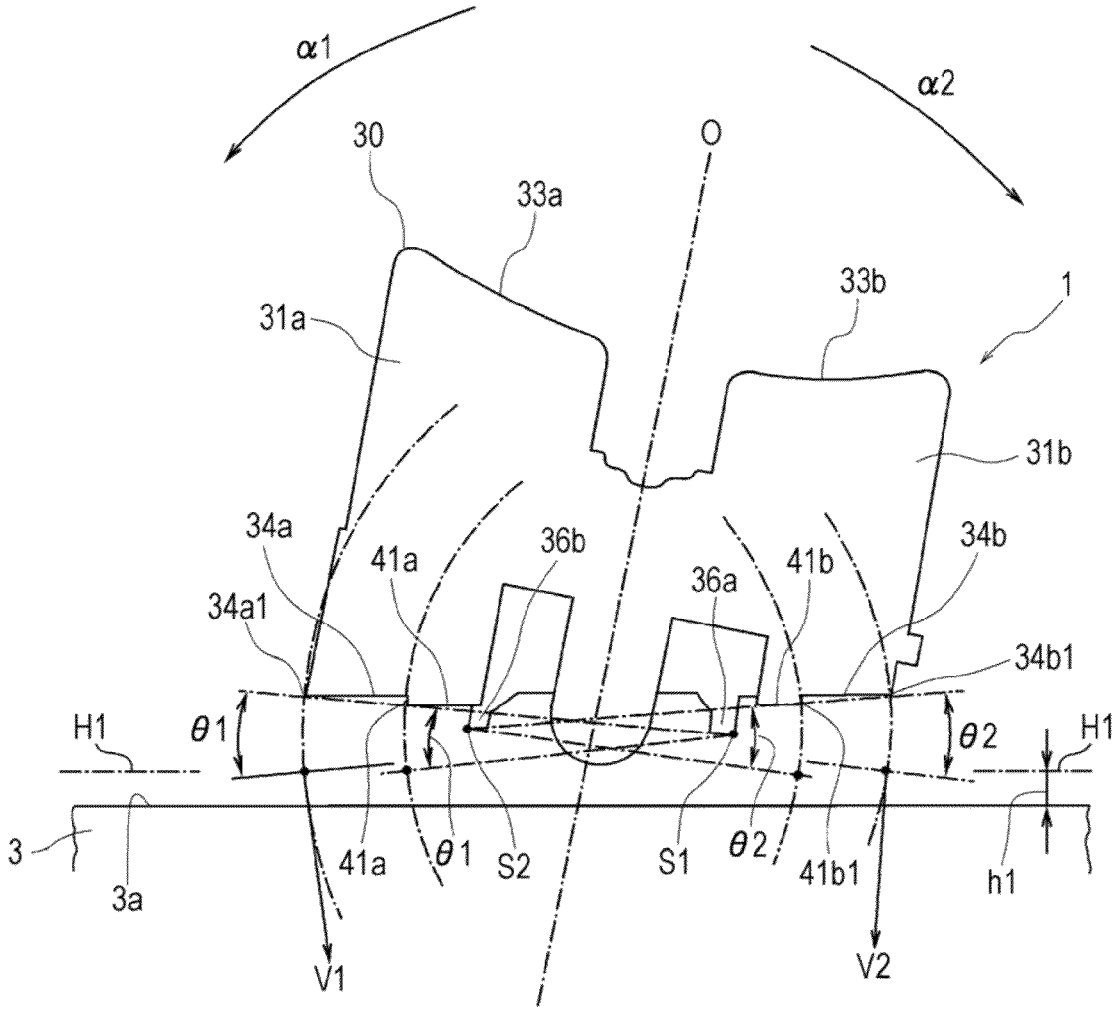
FIG. 9 is an enlarged explanatory view showing the operation of the push button unit of the pressing-type input device of the embodiment.
Figure 10:
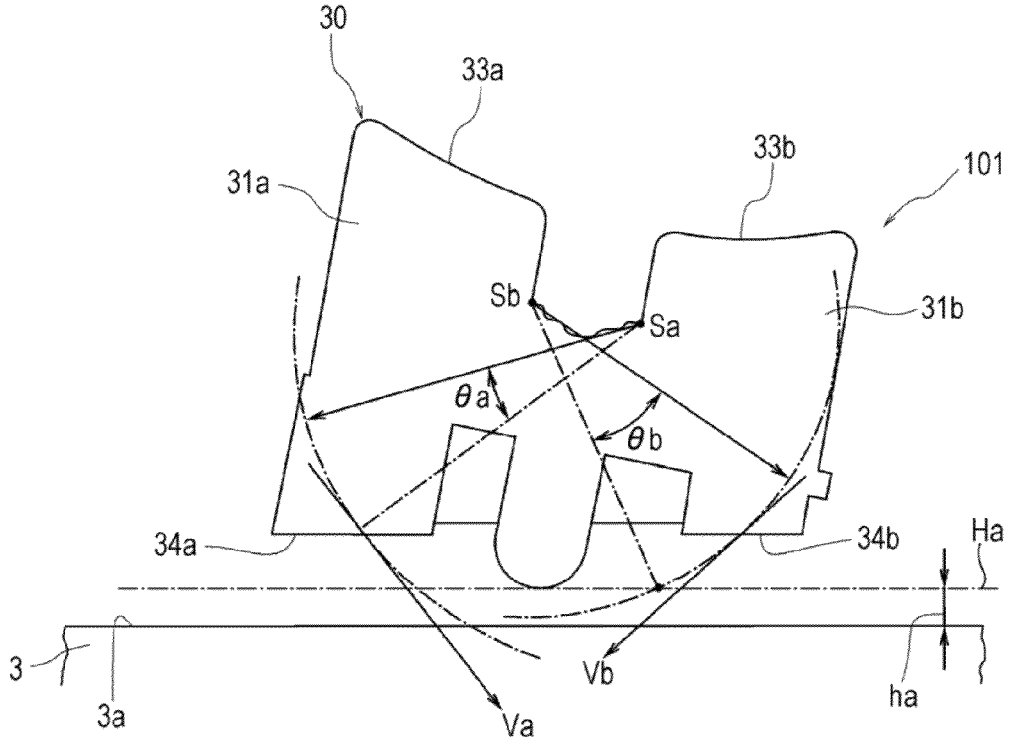
FIG. 10 is an enlarged explanatory view showing the operation of the push button unit of the pressing-type input device of the comparative example.

FIG. 9 shows scaled-up details of the rotation of the push button unit 30 in the pressing-type input device 1 of the embodiment of the present invention. FIG. 10 shows scaled-up details of the rotation of the push button unit 30 in the pressing-type input device 101 of the comparative example.

In FIG. 9 and FIG. 10, the surface 3*a* of the switching substrate 3 is horizontal. In FIG. 9 is shown a pressing reference line H1 at a height h1 in the vertical direction from the surface 3*a*. In FIG. 10 is shown a pressing reference line Ha at a height ha in the vertical direction from the surface 3*a*.

In the pressing-type input device 1 of the comparative example shown in FIG. 10, the rotation angle θb of the push button unit 30 necessary to lower the center of the second pressing end portion 34*b* to the pressing reference line Ha by pressing the second operating surface 33*b* is extremely larger than the rotation angle θa of the push button unit 30 necessary to lower the center of the first pressing end portion 34*a* to the pressing reference line Ha by pressing the first operating surface 33*a*.

In addition, since the first contact portion Sa and the second contact portion Sb are upwardly distant from the surface of the switching substrate 3, a vector Va in which the center of the first pressing end portion 34*a* moves toward the surface 3*a* when the first operating surface 33*a* is pressed and a vector Vb in which the center of the second pressing end portion 34*b* moves toward the surface 3*a* when the second operating surface 33*b* is pressed are at acute angles with respect to the surface 3*a*. Therefore, the pressing portion 21*a* of the first switching portion 4*a* cannot be pressed perpendicularly to the surface 3*a* with the first pressing end portion 34*a*, the pressing portion 21*b* of the second switching portion 4*b* cannot be pressed perpendicularly to the surface 3*a* with the second pressing end portion 34*b*, and the pressing operational sensation is bad.

As shown in FIG. 9, in the pressing-type input device 1 of the embodiment of the present invention, the first contact portion Si and the second contact portion S2 are at substantially the same height from the surface 3*a* of the switching substrate 3. Therefore, the rotation angle θ1 of the push button unit 30 necessary to lower the first pressing end portion 34*a* to the pressing reference line H1 by pressing the first operating surface 33*a* is substantially equal to the rotation angle θ2 of the push button unit 30 necessary to lower the second pressing end portion 34*b* to the pressing reference line H1 by pressing the second operating surface 33*b*.

In addition, the distance from the first contact portion Si to the surface 3*a* of the switching substrate 3 is shorter than the distance from the first contact portion Si to the second operating surface 33*b*, and the distance from the second contact portion S2 to the surface 3*a* of the switching substrate 3 is shorter than the distance from the second contact portion S2 to the first operating surface 33*a*. In addition, in this embodiment, when the push button unit 30 is not being operated, the first contact portion S1 is closer to the surface 3*a* than the second pressing end portion 34*b*, and the second contact portion S2 is closer to the surface 3*a* than the first pressing end portion 34*a*.

Therefore, a vector V1 in which the first pressing end portion 34*a* moves toward the surface 3*a* when the first operating surface 33*a* is pressed and a vector V2 in which the second pressing end portion 34*b* moves toward the surface 3*a* when the second operating surface 33*b* is pressed are at obtuse angles close to a right angle with respect to the surface 3*a*. Therefore, the first switching portion 4*a* can be pressed substantially perpendicularly to the surface 3*a* with the first pressing end portion 34*a*, the second switching portion 4*b* can be pressed substantially perpendicularly to the surface 3*a* with the second pressing end portion 34*b*, and the pressing operational sensation is improved.

In addition, as shown in FIG. 9, in the pressing-type input device 1 of this embodiment, an inner part 41*a* of the first pressing end portion 34*a* close to the center line O is protruding toward the surface 3*a*, and an inner part 41*b* of the second pressing end portion 34*b* close to the center line O is protruding toward the surface 3*a*. Therefore, when the push button unit 30 has rotated by θ1 in the α1 direction, the outer end 34*a*1 of the first pressing end portion 34*a* and the outer end 41*a*1 of the inner part 41*a* reach the pressing reference line H1 at substantially the same time. Similarly, when the push button unit 30 has rotated by θ2 in the α2 direction, the outer end 34*b*1 of the second pressing end portion 34*b* and the outer end 41*b*1 of the inner part 41*b* reach the pressing reference line H1 at substantially the same time.

Owing to this configuration, the pressing portion 21*a* of the first switching portion 4*a* and the pressing portion 21*b* of the second switching portion 4*b* can be pressed toward the surface 3*a* of the switching substrate 3 perpendicularly, and the pressing operational sensation is further improved.

Although, in the above embodiment, the first contact portion S1 and the second contact portion S2 are formed in contact portions between the third push button 31*c* and the case 2 and contact portions between the fourth push button 31*d* and the case 2, the first contact portion S1 and the second contact portion S2 may be formed in contact portions between the third push button 31*c* and a fixed portion other than the case 2 provided in the case 2 and contact portions between the fourth push button 31*d* and the fixed portion. The same goes for the third contact portion S3 and the fourth contact portion S4.

What is claimed is:

1. A pressing-type input device comprising:

a case having a top surface;

a push button unit including:

a first push button and a second push button protruding through the top surface of the case, the first push button having a first operating surface for receiving pressing operating force and a first pressing end portion, the second push button having a second operating surface for receiving pressing operating force and a second pressing end portion, a distance between the first operating surface and the first pressing end portion being longer than a distance between the second operating surface and the second pressing end portion; and a connecting portion connecting the first push button and the second push button, a first switching portion configured to be pressed by the first pressing end portion of the first push button;

a second switching portion configured to be pressed by the second pressing end portion of the second push button; and a first contact portion and a second contact portion provided between the push button unit and the case or a fixed portion other than the case, wherein:

the first contact portion is provided on a second push button side of a center line passing between the first push button and the second push button, the first contact portion serving as a pivot point for the push button unit when the first operating surface is pressed;

the second contact portion is provided on a first push button side of the center line, the second contact portion serving as a pivot point for the push button unit when the second operating surface is pressed; and a first distance from the first operating surface to the second contact portion is longer than a second distance from the second operating surface to the first contact portion.

2. The pressing-type input device according to claim 1, further comprising:

a switching substrate attached to the case so as to have an angle with respect to the top surface of the case, the switching substrate supporting the first switching portion and the second switching portion, wherein a distance from the top surface of the case to the first switching portion is longer than a distance from the top surface of the case to the second switching portion.

3. The pressing-type input device according to claim 2, wherein a distance from the first contact portion to the switching substrate is shorter than the second distance from the second operating surface to the first contact portion, and a distance from the second contact portion to the switching substrate is shorter than the first distance from the first operating surface to the second contact portion.

4. The pressing-type input device according to claim 3, wherein the first contact portion is closer to the switching substrate than the second pressing end portion, and the second contact portion is closer to the switching substrate than the first pressing end portion.

5. The pressing-type input device according to claim 1, wherein the first push button and the second push button are arranged in a first direction, the push button unit further includes:

a third push button having a third operating surface and a third pressing end portion;

a fourth push button having a fourth operating surface and a fourth pressing end portion, the third and fourth push buttons being arranged in a second direction intersecting the first direction;

a third switching member configured to be pressed by the third pressing end portion of the third push button; and a fourth switching member configured to be pressed by the fourth pressing end portion of the fourth push button, and wherein the first contact portion and the second contact portion are provided between the third push button and the case or the fixed portion and between the fourth push button and the case or the fixed portion.

6. The pressing-type input device according to claim 5, further comprising:

a third contact portion serving as a pivot point for the push button unit when the third push button is pressed; and a fourth contact portion serving as a pivot point for the push button unit when the fourth push button is pressed, wherein the third and fourth contact portions are provided between the first push button and the case or the fixed portion and between the second push button and the case or the fixed portion.

7. The pressing-type input device according to claim 5, wherein the case further includes:

a first guide portion configured to receive and pivotably accommodate the first push button;

a second guide portion configured to receive and pivotably accommodate the second push button;

a third guide portion configured to receive and pivotably accommodate the third push button; and a fourth guide portion configured to receive and pivotably accommodate the fourth push button.

8. The pressing-type input device according to claim 5, wherein a distance from the third operating surface to the third pressing end portion and a distance from the fourth operating surface to the fourth pressing end portion are substantially the same.

9. The pressing-type input device according to claim 1, wherein the case further includes:

a first guide portion configured to receive and pivotably accommodate the first push button; and a second guide portion configured to receive and pivotably accommodate the second push button.

10. A pressing-type input device comprising:

a case having a top surface;

a push button unit including:

a first push button having a first operating surface receiving pressing operation force and a first pressing portion;

a second push button having a second operating surface receiving pressing operation force and a second pressing portion;

a third push button having a third operating surface receiving pressing operation force and a third pressing portion; and a fourth push button having a fourth operating surface receiving pressing operation force and a fourth pressing portion; and a connecting portion connecting the first, second, third, and fourth push buttons;

a first switching portion configured to be pressed by the first pressing portion of the first push button;

a second switching portion configured to be pressed by the second pressing portion of the second push button;

a third switching portion configured to be pressed by the third pressing portion of the third push button; and a fourth switching portion configured to be pressed by the fourth pressing portion of the fourth push button, wherein the first push button and the second push button are arranged in a first direction, and the third push button and the fourth push button are arranged in a second direction intersecting the first direction, wherein a distance from the first operating surface to the first pressing end portion is longer than a distance from the second operating surface to the second pressing end portion, wherein the pressing-type input device further comprises:

a first contact portion and a second contact portion provided between the third push button and the case or a fixed portion other than the case and between the fourth push button and the case or the fixed portion, the first contact portion being provided on a second push button side of a center line passing between the first push button and the second push button, and serving as a pivot point for the push button unit when the first operating surface is pressed, and the second contact portion being provided on a first push button side of the center line, and serving as a pivot point for the push button unit when the second operating surface is pressed, and wherein a first distance from the first operating surface to the second contact portion is longer than a second distance from the second operating surface to the first contact portion.

11. The pressing-type input device according to claim 10, further comprising:

a third contact portion serving as a pivot point for the push button unit when the third push button is pressed; and a fourth contact portion serving as a pivot point for the push button unit when the fourth push button is pressed, wherein the third and fourth contact portions are provided between the first push button and the case or the fixed portion and between the second push button and the case or the fixed portion.

12. The pressing-type input device according to claim 10, wherein the case further includes:

a first guide portion configured to receive and pivotably accommodate the first push button;

a second guide portion configured to receive and pivotably accommodate the second push button;

a third guide portion configured to receive and pivotably accommodate the third push button; and a fourth guide portion configured to receive and pivotably accommodate the fourth push button.

13. The pressing-type input device according to claim 10, wherein a distance from the third operating surface to the third pressing end portion and a distance from the fourth operating surface to the fourth pressing end portion are substantially the same.

* * * * *